US007938342B2

(12) United States Patent
Octeau et al.

(10) Patent No.: US 7,938,342 B2
(45) Date of Patent: May 10, 2011

(54) SPRAY NOZZLE COMPRISING AXIAL GROOVES TO PROVIDE A BALANCE SUPPLY TO THE VORTEX CHAMBER

(75) Inventors: Jean-Luc Octeau, Intraville (FR); Pierre Dumont, Mochy-sur-EU (FR); Jean-Pierre Songbe, Pierre en Val (FR); Herve Imenez, Mons Bourbert (FR)

(73) Assignee: Rexam Dispensing Systems S.A.S (FR)

( * ) Notice: Subject to any disclaimer, the term of this patent is extended or adjusted under 35 U.S.C. 154(b) by 393 days.

(21) Appl. No.: 12/142,486

(22) Filed: Jun. 19, 2008

(65) Prior Publication Data

US 2008/0315016 A1 Dec. 25, 2008

(30) Foreign Application Priority Data

Jun. 19, 2007 (FR) ..... 07 04373

(51) Int. Cl.
*B05B 1/34* (2006.01)

(52) U.S. Cl. ..... 239/476; 239/333; 239/337; 239/469; 239/490; 239/492

(58) Field of Classification Search ..... 239/333, 239/337, 468, 469, 476, 490–492
See application file for complete search history.

(56) References Cited

U.S. PATENT DOCUMENTS 1,461,545 A 7/1923 Purnell
4,071,196 A 1/1978 Burke et al.
5,388,766 A * 2/1995 Buisson ..... 239/333
5,711,488 A * 1/1998 Lund ..... 239/333
5,738,282 A * 4/1998 Grogan ..... 239/492
6,533,196 B1 * 3/2003 Ouin et al. ..... 239/476

FOREIGN PATENT DOCUMENTS

DE 4324607 A1 8/1994

OTHER PUBLICATIONS

French Search Report, Mar. 3, 2008 (6).

* cited by examiner

*Primary Examiner* — Steven J Ganey
(74) *Attorney, Agent, or Firm* — St. Onge Steward Johnston & Reens LLC

(57) ABSTRACT

A spray nozzle designed to be mounted in a push button of a liquid distribution system, including a body equipped with an assembly tube that is defined by a front wall in which a distribution orifice is formed, wherein the inside face of the front wall is equipped with a vortex chamber that communicates with the distribution orifice, at least two radial tubes to supply liquid to the vortex chamber, and an annular duct to supply liquid to the upstream end of the tubes, in which the lateral inside wall of the tube is equipped with at least two axial grooves which respectively extend between an upstream end opening onto the rear edge of the tube and a downstream end opening onto the annular duct, wherein the grooves are positioned angularly so that each downstream end of a groove is equidistant from the two upstream ends of the tube adjacent to it on either side along the length of the annular duct.

16 Claims, 2 Drawing Sheets

SPRAY NOZZLE COMPRISING AXIAL GROOVES TO PROVIDE A BALANCE SUPPLY TO THE VORTEX CHAMBER

CROSS REFERENCED APPLICATIONS

The present application claims priority of French patent application No. 07 04373 filed on Jun. 19, 2007, the content of which is incorporated herein by reference.

FIELD OF THE INVENTION

The invention relates to a spray nozzle designed to be mounted in a push button of a liquid distribution system, such a push button and such a distribution system.

BACKGROUND OF THE INVENTION

In one specific application, the distribution system is designed to equip bottles used for perfumery, cosmetics or pharmaceutical treatments. Indeed, this type of bottle contains a liquid that is distributed by a distribution system comprising a pump or a manually actuated valve, wherein said system is actuated by a push button to allow the liquid to be sprayed.

Such push buttons are normally made of two parts: an actuator body and a spray nozzle for the liquid which are associated to one another to form the push button. In particular, the spray nozzle may also be fitted so that it forms an aerosol with the liquid, especially when it is equipped with a "vortex" chamber.

For this purpose, the vortex chamber is fitted out so that it spins the liquid very quickly so that the latter gathers speed. Consequently, by providing that the vortex chamber is extended by a distribution orifice in its centre, the liquid may escape at high speed by dividing into droplets forming the aerosol.

The aerosol is formed by fine droplets of various sizes, and approximately has a cone shape which is characterised by its angle, the substantially oval shape of the cross section perpendicular to the distribution axis and by the distribution of the droplets in this section.

With the spray nozzles of the prior art, the features of the aerosol depend on the orientation of the nozzle in the push button. However, this orientation cannot be imposed on the assembly lines, resulting in aerosols that are randomly different with distribution systems comprising a same nozzle-push button assembly.

Consequently, the features of the aerosol may not be guaranteed, which is detrimental for technical reasons for the use of the aerosol as well as for human health reasons as droplets that are too fine may be inhaled by the user.

SUMMARY OF THE INVENTION

The purpose of the invention is to overcome the problems of the prior art by especially proposing a spray nozzle to produce an aerosol whose features are independent of the angular positioning of the nozzle in the push button.

For this purpose, and according to a first aspect, the invention proposes a spray nozzle designed to be mounted in a push button of a liquid distribution system, wherein said nozzle comprises a body equipped with an assembly tube that is defined by a front wall inside which a distribution orifice is formed, wherein the inside face of said front wall has a vortex chamber that communicates with the distribution orifice, at least two radial tubes to supply the liquid to said vortex chamber, and an annular duct to supply the liquid to the upstream end of said tubes, in which the lateral inside wall of the tube has at least two axial grooves which respectively extend between an upstream end opening onto the rear edge of the tube and a downstream end opening onto the annular duct, wherein said grooves are positioned angularly so that each downstream end of a groove is equidistant from the two upstream ends of the tube that are adjacent to it on either side along the length of the annular duct.

According to a second aspect, the invention proposes a push button for a liquid distribution system, wherein said push button comprises a body in which a distribution path is formed, wherein said distribution path has a downstream end which opens into a cavity formed in said body, wherein said push button further comprises such a spray nozzle, wherein said nozzle is associated inside said cavity to the downstream end of the distribution path which communicates with the axial grooves.

According to a third aspect, the invention proposes a liquid distribution system comprising a pump or a manually actuated valve onto which such a push button is mounted so that the liquid may be sprayed.

BRIEF DESCRIPTION OF THE DRAWINGS

Other subject maters and advantages of the invention will become clearer in the following description, made in reference to the appended figures in which.

DETAILED DESCRIPTION OF THE INVENTION

Figure 1A:
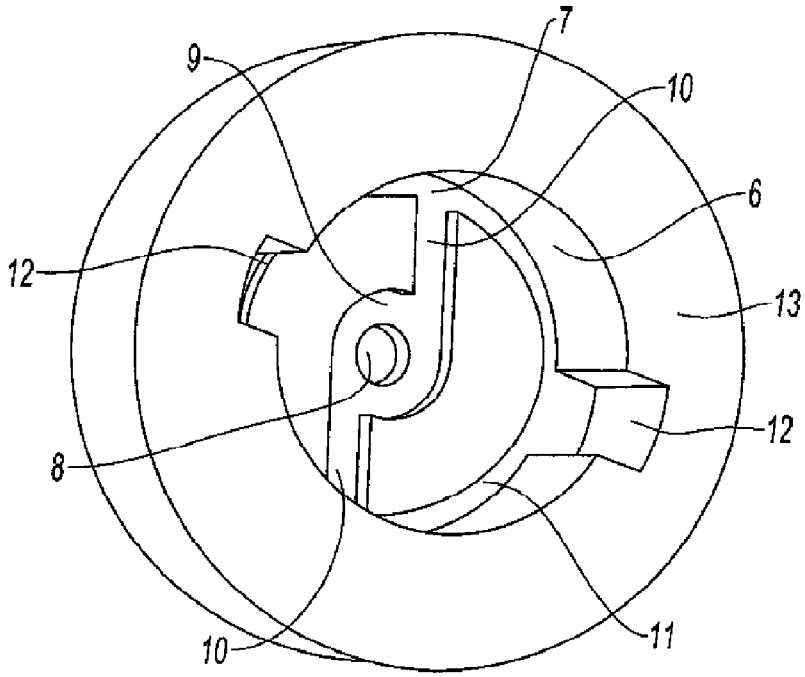
FIG. 1 show a spray nozzle according to one embodiment of the invention, respectively a perspective view (FIG. 1*a*) and a rear view (FIG. 1*b*)

In relation to the FIG. 2, a spray push button for a liquid distribution system is described below, wherein said liquid may be of any nature, especially used for perfumery, cosmetics or pharmaceutical treatments.

The push button comprises a body 1 inside which a distribution path is formed. Furthermore, the body 1 has an annular skirt with an aspect 2 that is surmounted by a cavity 3 for assembling the push button onto the distribution system. Moreover, the push button comprises an upper zone 4 allowing the user to exert finger pressure on said push button in order to move it axially.

In particular, the distribution system may comprise a jet (not shown) that is inserted imperviously into the cavity 3. As may be found in the prior art, the distribution system further comprises means for assembling it onto a bottle containing the liquid and means for removing the liquid from inside said bottle that are fitted so as to supply the jet with a pressurised liquid.

For this purpose, the distribution system comprises a manually actuated pump or, in the case of the liquid being stored under pressure in the bottle, a manually actuated valve. Consequently, when the push button is moved manually, the pump or the valve is actuated to supply the jet with a pressurised liquid.

The body 1 also has an annular cavity 5 with an axis perpendicular to that of the assembly cavity 3, wherein the downstream end of the distribution path opens onto said cavity.

In relation to the FIG. 1, the spray nozzle that is mounted inside the cavity 5 is described below, wherein said nozzle comprises a body equipped with an assembly tube 6 that is defined by a front wall 7 inside which a distribution orifice 8 is formed. The tube 6 has an inside cylindrical rotational geometry. The nozzle is positioned collinearly to the axis of the cavity 5 to permit lateral spraying of the liquid in relation to the body 1 of the push button.

The inside face of the front wall 7 is equipped with a vortex chamber 9 which communicates with the distribution orifice 8 so as to form an aerosol. Furthermore, two radial tubes 10 are also formed on the inside face to supply the liquid to the vortex chamber 9. In the embodiment shown, the tubes 10 supply the vortex chamber 9 tangentially so as to favour the rotation of the liquid inside the chamber 9, which has a cylindrical rotational geometry, wherein the distribution orifice 8 is formed in the centre of said chamber.

According to embodiments that are not shown, other geometries of vortex chambers, a different supply to said chamber and/or more than two, especially three, supply tubes are used.

The inside face of the front wall is also equipped with an annular duct 11 to supply liquid to the upstream end of the supply tubes 10 of the vortex chamber 9. In particular, the vortex chamber 9, the radial tubes 10 and the annular supply duct 11 are formed by hollow sections of the front wall 7.

The lateral inside wall of the tube has two axial grooves 12 which respectively extend between an upstream end opening onto the rear edge 13 of the tube 6 and a downstream end opening onto the annular duct 11. Consequently, the grooves 12 allow the supply of liquid to the vortex chamber 9 successively by means of the annular duct 11 and the radial tubes 10.

To balance the supply of the vortex chamber 9, the grooves 12 are positioned angularly so that each downstream end of a groove 12 is equidistant from the two upstream ends of the tube 10 adjacent to it on either side along the length of the annular duct 11. Consequently, the fractions of liquid supplying each of the tubes 10 have followed exactly the same path along the annular duct 11, so that they have the same dynamic features. Consequently, regardless of the orientation of the nozzle in the push button, an identical aerosol is obtained for which the supply of liquid is balanced.

In particular, the number of grooves 12 may be equal to the number of tubes 10. Moreover, the downstream ends of the grooves 12 and the upstream ends of the tubes 10 may be respectively equi-spaced angularly, wherein said downstream ends of the grooves 12 are offset angularly with respect to said upstream ends of the tubes 10 by a pitch equal to 360° divided by twice the number of tubes 10.

Figure 1B:
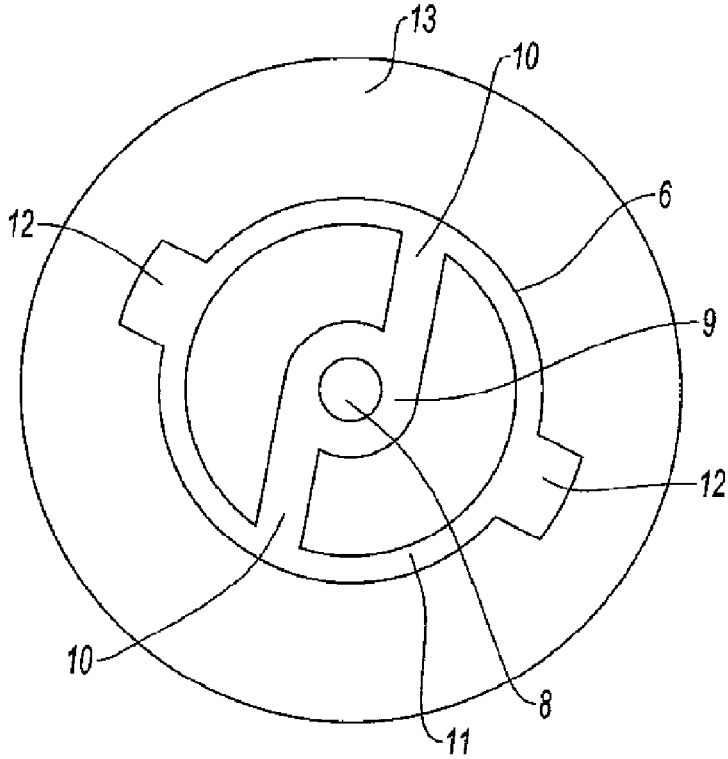

In the FIG. 1, two grooves 12 are formed axially at 180° to one another on the lateral inside wall of the tube 6, and two tubes 10 are formed symmetrically with their upstream orifices at 180° to one another. The downstream ends of the grooves 12 are offset angularly with respect to said upstream ends of the tubes 10 by a pitch equal to 90°. Consequently, on either side of the downstream end of the grooves 12, the fractions of liquid must pass through 45° along the annular duct 11 to supply the tubes 10.

This set-up is particularly advantageous when combined with a distribution path comprising a single axial duct 17 to supply the nozzle. Indeed, in this case, even if the supply of the grooves 12 is not balanced, the supply of all the tubes 10 remains balanced.

As a variant that is not shown, three grooves at 120° from one another are formed to supply three tubes also angularly positioned at 120°, wherein the downstream ends of the grooves are offset angularly with respect to said upstream ends of the tubes y a pitch equal to 60°. Consequently, on either side of the downstream end of the grooves, the fractions of liquid must pass through 30° along the annular duct to supply the tubes.

Figure 2:
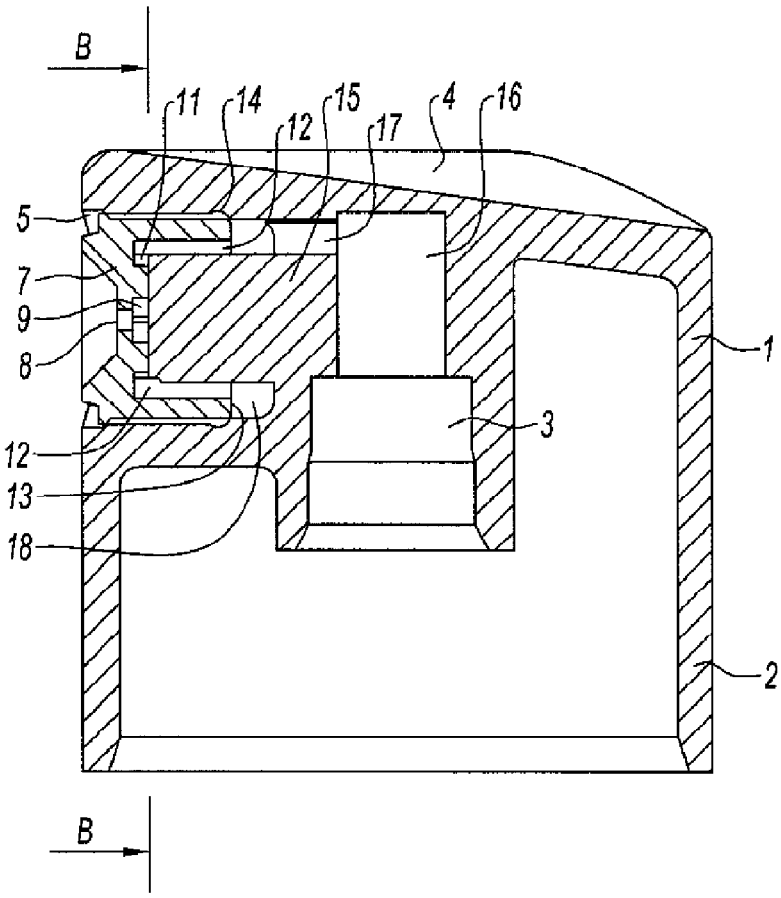
FIG. 2 is a longitudinal cross sectional view of a push button comprising a spray nozzle according to FIG. 1.
Figure 2A:
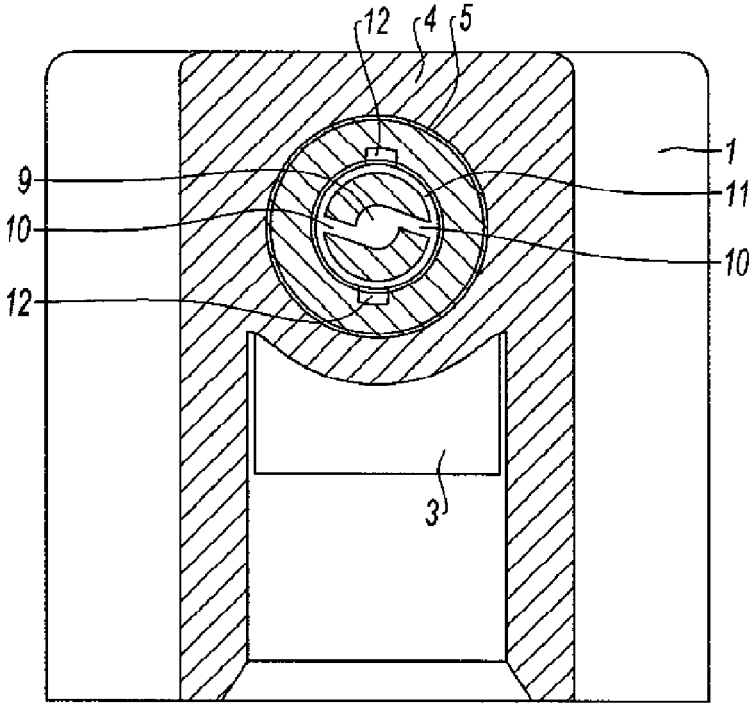
FIG. 2*a* is a cross sectional view according to the B-B line of FIG. 2.

In the FIG. 2, the outside face of the rear edge 13 of the tube is equipped with a radial protrusion 14 to fix it in the bore of the cavity 5. Furthermore, the cavity 5 comprises a central pin 15 onto which the lateral inside wall of the tube 6 is fitted imperviously thus leaving the grooves 12 free so that they may be supplied with liquid via the distribution path.

For this purpose, the distribution path comprises from upstream to downstream, a radial duct 16, an axial duct 17 and an annular duct 18 formed around the pin 15, wherein the upstream end of the grooves 12 opens onto said annular duct.

Furthermore, the front wall of the tube 6 is in contact with the end of the pin 15, wherein the vortex chamber 9, the radial tubes 10 and the annular supply duct 11 are defined axially between said wall and said end.

As a variant, especially in the case of a nasal nozzle, the annular cavity 5 may be coaxial with the cavity 3 and the radial duct 16. In another variant, the vortex chamber 9 is combined with the distribution orifice 8.

What is claimed is:

1. Spray nozzle designed to be mounted in a push button of a liquid distribution system, where said nozzle comprises a body equipped with an assembly tube that is defined by a front wall in which a distribution orifice is formed, wherein the inside face of said front wall is equipped with:

a vortex chamber that communicates with the distribution orifice;

at least two radial tubes to supply the liquid to said vortex chamber; and an annular duct to supply the liquid to the upstream end of said tubes, wherein said nozzle is characterised in that the lateral inside wall of the tube is equipped with at least two axial grooves which respectively extend between an upstream end opening onto the rear edge of the tube and a downstream end opening onto the annular duct, wherein said grooves are positioned angularly so that each downstream end of a groove is equidistant from the two upstream ends of the tube adjacent to it on either side along the length of the annular duct.

2. Spray nozzle according to claim 1, characterised in that the number of grooves is equal to the number of tubes.

3. Spray nozzle according to claim 2, characterised in that the downstream ends of the grooves and the upstream ends of the tubes are respectively equi-spaced angularly, wherein said downstream ends of the grooves are offset angularly with respect to said upstream ends of the tubes by a pitch equal to 360° divided by twice the number of tubes.

4. The spray nozzle according to claim 3, characterised in that the vortex chamber, the radial tubes and the annular supply duct are formed by hollow sections of the front wall.

5. The spray nozzle according to claim 3, characterised in that the outside face of the rear edge of the tube is equipped with a radial protrusion to fix it to the push button.

6. The spray nozzle according to claim 2, characterised in that the vortex chamber, the radial tubes and the annular supply duct are formed by hollow sections of the front wall.

7. The spray nozzle according to claim 2, characterised in that the outside face of the rear edge of the tube is equipped with a radial protrusion to fix it to the push button.

8. The spray nozzle according to claim 1, characterised in that the vortex chamber, the radial tubes and the annular supply duct are formed by hollow sections of the front wall.

9. The spray nozzle according to claim 8, characterised in that the outside face of the rear edge of the tube is equipped with a radial protrusion to fix it to the push button.

10. Spray nozzle according to claim 1, characterised in that the outside face of the rear edge of the tube is equipped with a radial protrusion to fix it to the push button.

11. Spray nozzle designed to be mounted in a push button of a liquid distribution system, where said nozzle comprises a body equipped with an assembly tube that is defined by a front wall in which a distribution orifice is formed, wherein the inside face of said front wall is equipped with:

a vortex chamber that communicates with the distribution orifice;

at least two radial tubes to supply the liquid to said vortex chamber; and an annular duct to supply the liquid to the upstream end of said tubes, wherein said nozzle is characterised in that the lateral inside wall of the tube is equipped with at least two axial grooves which respectively extend between an upstream end opening onto the rear edge of the tube and a downstream end opening onto the annular duct, wherein said grooves are positioned angularly so that each downstream end of a groove is equidistant from the two upstream ends of the tube adjacent to it on either side along the length of the annular duct;

wherein said push button comprises a body in which a distribution path is formed, said distribution path having a downstream end which opens onto a cavity formed inside said body; and wherein said spray nozzle is associated inside said cavity to the downstream end of the distribution path that communicates with the axial grooves.

12. Push button according to claim 11, characterised in that the cavity comprises a central pin onto which the lateral inside wall of the tube is fitted to leave the grooves free.

13. Push button according to claim 12, characterised in that the distribution path comprises from upstream to downstream, a radial duct, an axial duct and an annular duct formed around the pin, wherein the upstream end of the grooves opens onto said annular duct.

14. The push button according to claim 13, characterised in that the front wall of the tube is in contact with the end of the pin, wherein the vortex chamber, the radial tubes and the annular supply duct are defined axially between said wall and said end.

15. Push button according to claim 12, characterised in that the front wall of the tube is in contact with the end of the pin, wherein the vortex chamber, the radial tubes and the annular supply duct are defined axially between said wall and said end.

16. Spray nozzle designed to be mounted in a push button of a liquid distribution system, where said nozzle comprises a body equipped with an assembly tube that is defined by a front wall in which a distribution orifice is formed, wherein the inside face of said front wall is equipped with:

a vortex chamber that communicates with the distribution orifice;

at least two radial tubes to supply the liquid to said vortex chamber; and an annular duct to supply the liquid to the upstream end of said tubes, wherein said nozzle is characterised in that the lateral inside wall of the tube is equipped with at least two axial grooves which respectively extend between an upstream end opening onto the rear edge of the tube and a downstream end opening onto the annular duct, wherein said grooves are positioned angularly so that each downstream end of a groove is equidistant from the two upstream ends of the tube adjacent to it on either side along the length of the annular duct;

wherein said push button comprises a body in which a distribution path is formed, said distribution path having a downstream end which opens onto a cavity formed inside said body; and wherein said spray nozzle is associated inside said cavity to the downstream end of the distribution path that communicates with the axial grooves; and wherein said liquid distribution system comprises a pump or a manual actuated valve onto which a push button is mounted to allow liquid to be sprayed.

* * * * *